US006302783B1

(12) United States Patent
Vroege

(10) Patent No.: US 6,302,783 B1
(45) Date of Patent: Oct. 16, 2001

(54) AIR-CONDITIONING DEVICE

(76) Inventor: Norbert Peter Vroege, Westergracht 25 rd, NL-02013 ZJ, Haarlem (NL)

( * ) Notice: Subject to any disclaimer, the term of this patent is extended or adjusted under 35 U.S.C. 154(b) by 0 days.

(21) Appl. No.: 09/530,340

(22) PCT Filed: Oct. 28, 1998

(86) PCT No.: PCT/NL98/00623

§ 371 Date: Oct. 10, 2000

§ 102(e) Date: Oct. 10, 2000

(87) PCT Pub. No.: WO99/22184

PCT Pub. Date: May 6, 1999

(30) Foreign Application Priority Data

Oct. 28, 1997 (NL) ..... 1007379

(51) Int. Cl.[7] ..... F24F 1/00

(52) U.S. Cl. ..... 454/233; 454/236; 55/338; 55/418; 55/473

(58) Field of Search ..... 454/201, 207, 454/205, 236, 233; 236/13; 62/262, 263; 55/467, 471, 472, 473, 418, 338

(56) References Cited

U.S. PATENT DOCUMENTS 3,299,796 * 1/1967 Toper et al. ..... 454/236
3,935,803 * 2/1976 Bush ..... 454/189
4,210,429 * 7/1980 Golstein ..... 55/279
4,705,457 11/1987 Belusa .
4,731,903 * 3/1988 Kennedy et al. ..... 16/224
4,759,196 * 7/1988 Davis ..... 62/326
5,225,167 7/1993 Wetzel .

FOREIGN PATENT DOCUMENTS

2015943 * 10/1971 (DE) .
3632268 A1 4/1988 (DE) .
2208098 * 6/1974 (FR) .
WO 9530862 11/1995 (WO) .

* cited by examiner

*Primary Examiner*—Jiping Lu
(74) *Attorney, Agent, or Firm*—Young & Thompson

(57) ABSTRACT

Air-conditioning device includes a holder which is to be arranged against the wall of the room and is provided with a top wall, front wall, side walls, base and rear wall. An opening for the supply of fresh air form the environment is arranged in the rear wall. An air-inlet opening for the air from the room is arranged in the base, while an air-outlet opening is arranged on the top side. The supply of fresh air and inlet opening emerge in a first chamber in which a fan is arranged. A HEPA filter is connected to this chamber. A control device is provided in order to control the ratio between the fresh air flowing in and the air from the room in question.

10 Claims, 5 Drawing Sheets

AIR-CONDITIONING DEVICE

BACKGROUND OF THE INVENTION

The present invention relates to an air-conditioning device.

DESCRIPTION OF THE RELATED ART

Such an air-conditioning device is known from French patent publication 2,208,098. This document describes a device which takes up a very large amount of space and, moreover, has such a high weight that it has to be placed on the floor of a room. This device is intended not only for ventilation but also for the displacement of heat, i.e. for introducing heat or cold into the room in question. Consequently, it is necessary to arrange a radiator or the like therein.

Increasingly, society will no longer accept the noise and odour pollution resulting from ever increasing volumes of traffic. This means both road and air traffic. Regulations relating to acceptable sound levels inside houses are becoming increasingly strict, so that there is an ever increasing need to carry out sound-insulating measures. Although such measures are easy to carry out in technical terms, they present the problem of limited ventilation.

The authorities are defining ever more clearly the requirements which are to be satisfied by ventilation in a room, and if these requirements cannot be met, building permits and the like may be refused.

Hithereto, ventilation has been achieved with the aid of sound-proofing boxes. The use of ventilators and other mechanical air-displacement means allows optimum ventilation to be ensured under all conditions. However, this entails large devices as described in French patent 2,208,098. Other examples of particularly complex, large devices of this nature are to be found in American patent 5,225,176 and PCT application WO 95/30862.

Particularly when retrofitting additional ventilation features after a room has been sound-insulated, it is impossible to use the devices shown in these publications, for their bulk is such that their installation requires major alterations, which will not be acceptable to existing residents.

SUMMARY OF THE INVENTION

The object of the present invention is to provide an air-conditioning device which can be of compact design and which does not entail any significant further increase in noise in the room in question. Moreover, it is important for a device of this nature to filter out harmful or undesirable substances as far as possible, while it is also intended that it should be possible to retrofit such a device in residences, offices and the like. Moreover, it is important that the mechanical displacement of air should take place as efficiently as possible, so that the device itself can be as efficient as possible.

Moreover, it is also sought to provide optimum filtering, i.e. to be able to filter out even very fine particles, such as soot particles.

This object is achieved in an air-conditioning device as described above, by means of the characterizing features of claim 1.

The arrangement of the invention allows a particularly compact design. Installing the mechanical air-displacement means, such as ventilators, makes it possible to overcome a relatively great pressure difference across the filter, i.e. a relatively dense filter can be used, making it possible to filter out even small particles, such as soot particles. Moreover, it has been found that the arrangement according to the invention produces particularly little noise while allowing particularly compact external dimensions. A level of approximately 25 dba for the filter is given as a non-limiting example.

Arranging the inlet opening in the base, in contrast to the device described in French patent 2,208,098, results in a more natural ventilation and makes it possible to limit the sound pressure further.

In a preferred embodiment, the control means may comprise mechanical control means, such as a flap assembly. This flap assembly controls the effective cross section of the inlet opening and of the opening for fresh air. Preferably, the flap assembly is designed in such a manner that the total cross-sectional area, through which air flows, of these two openings remains essentially the same in each position. Moreover, it is possible to provide the mechanical air-displacement means, such as a ventilator, with an electronic control unit, which makes it possible to control the flow rate through the air-conditioning device according to the invention.

According to a further variant of the invention, further mechanical air-displacement means are present.

By influencing the flow rate brought about by the two mechanical air-displacement means both in the absolute sense and with respect to one another, it is possible to provide very accurate control which is optimally adapted to the prevailing conditions, with the result that an optimally low power consumption is obtained.

This power consumption can be limited still further by designing at least one of the said air-displacement means as ventilators which are provided with DC motors.

According to a further advantageous embodiment of the invention, the outlet opening is arranged in a top surface which lies at a short distance below the free ends of its delimiting side, front and rear walls. The result is a further reduction in the sound pressure. Moreover, it has proven advantageous to arrange the mechanical air-displacement means for the inlet-outlet opening path as close as possible to the outlet opening and as far as possible from the inlet opening. The device according to the present invention can be retrofitted particularly advantageously in residences and will preferably be arranged at a reasonable height, in order, as far as possible, to avoid draught. The compact device according to the present invention allows this to take place in a simple manner.

Access to the filter, which will have to be cleaned periodically, is simple if the front wall of the holder is arranged so as to be at least partially removable. The filter may comprise any material which is known in the prior art. This filter may also comprise a combination of different layers. An example which may be mentioned is a so-called HEPA filter combined with a layer of activated carbon material. A filter of this nature may be arranged so that it is folded up inside the housing in question.

BRIEF DESCRIPTION OF THE DRAWINGS

The invention will be explained in more detail below with reference to exemplary embodiment which are depicted in the drawings, in which.

DESCRIPTION OF THE PREFERRED EMBODIMENT

Figure 1:
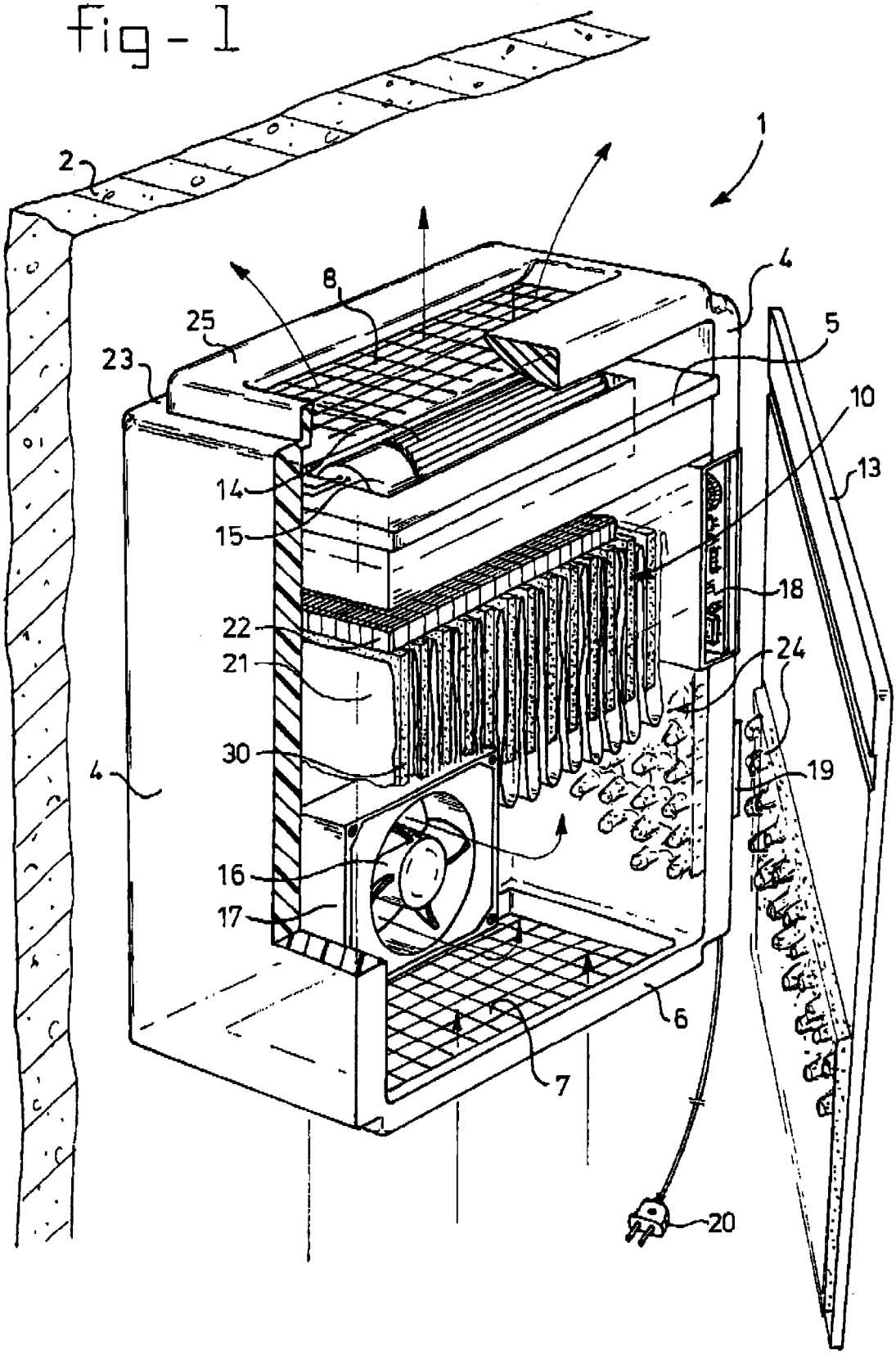
FIG. 1 shows a partially cut away, perspective view of the air-conditioning device according to the invention.
Figure 2:
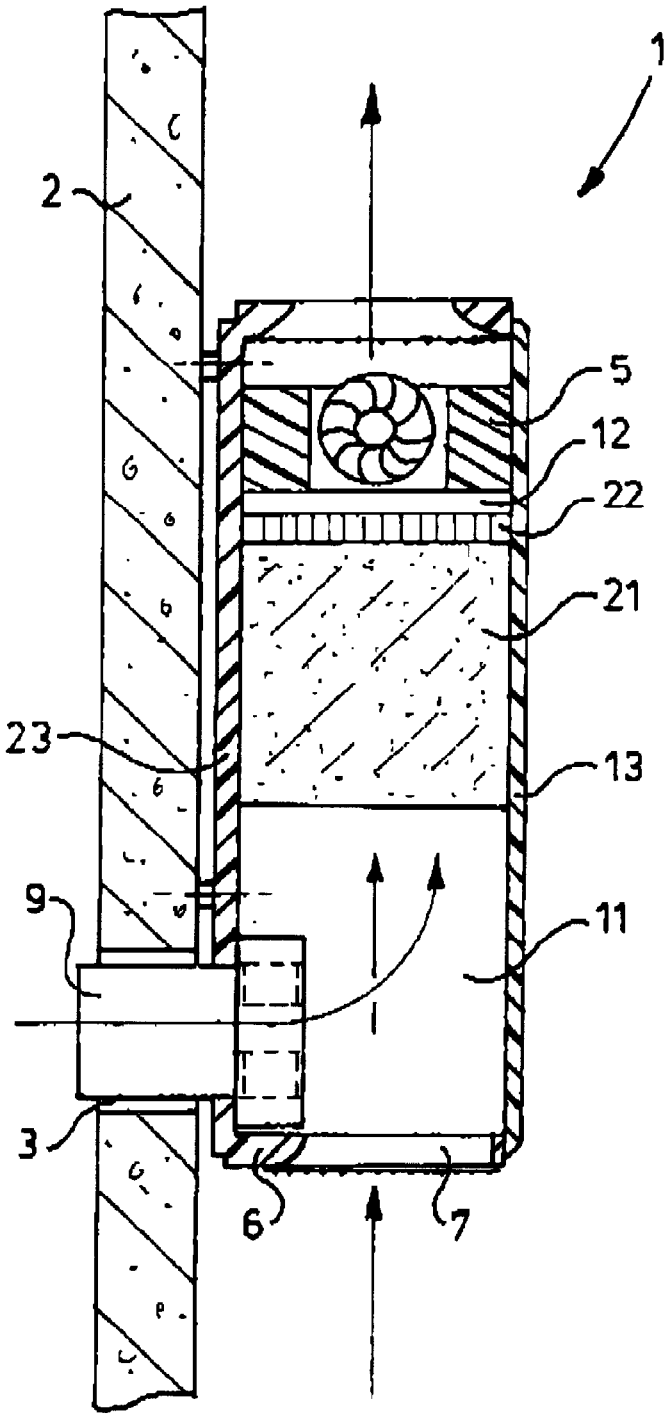
FIG. 2 shows a side view, in cross section, of the device in accordance with FIG. 1.

The air-conditioning device according to the invention is denoted overall by 1 in FIGS. 1 and 2. It is attached to wall 2 of a room by means of attachment means, which are not shown in more detail. This wall is the outside wall, and a hole 3 for supplying fresh air via the feed opening 9 for fresh air, which is arranged in the rear wall 23 of device 1, runs through this wall.

The device moreover comprises two opposite side walls 4 and a top wall 5 and base 6. A removable cover 13 is arranged on the front side. An inlet opening 7 is arranged in base 6, while top wall 5 is at a lower level than the top edge of rear wall 23, side walls 4 and cover 13, which edge is denoted by 25. Between inlet opening 7 and outlet opening 8, there is, firstly, a filter 10 and, then, a ventilator comprising a blade wheel 14 and a DC motor 15. The DC motors which are used here make it possible to improve the efficiency by at least 50% by comparison with the AC motors which are known in the prior art. Moreover, such motors, for example 24-volt motors, are very easy to control and the efficiency does not decline drastically in the relatively low load range. It has been found that optimum ventilation can be obtained at a very log power level. A power level of between, for example, 6 and 40 watts has been found to be a realistic level for each of the ventilators. In the vicinity of inlet opening 7, a further ventilator, comprising a blade wheel 16 and a motor 17, is arranged in feed opening 9 for fresh air. This latter ventilator is arranged in first chamber 11, while the ventilator comprising the components 14 and 15 is positioned in a second chamber 12.

A coarse filter which prevents moisture and coarse contaminating substances from the environment from entering may be arranged in feed opening 9. Moreover, the ventilator which is connected to said feed opening may be arranged sideways in the box.

The various walls may be lined with a sound-proofing material, such as a blister padding 24.

A control unit 18 is arranged on one of the side walls, which control unit, on the one hand, is connected to each of the ventilators, and, on the other hand, is provided with a control panel 19 and is also provided with a mains power supply, which is diagrammatically denoted by 20.

The filter described above is a folded filter structure on which a panel of activated carbon 22 is arranged. The folded filter structure comprises a filter layer of impregnated HEPA material 21, between which a further layer 30 of activated carbon is arranged. A filter of this nature is able to filter both larger dust particles (larger than approximately 2.5 $\mu$m) and very fine dust particles(smaller than 0.3 $\mu$m). It has been found that smaller dust particles, in particular, may be very harmful to health.

This filter assembly is designed as a cartridge, so that it is easy to replace.

A grate which is formed inductively and has sound-proofing properties may be arranged both downstream of the ventilator 14, 15 and in the inlet opening 7.

EXAMPLE

A height of approximately 40 cm, a depth of approximately 13 cm and a width of approximately 22 cm may be mentioned as possible dimensions for the air-conditioning device shown here. Such dimensions make it possible to achieve a circulation flow rate of approximately 150 $m^3/h$ and a ventilation flow rate of 75 $m^3/h$, which according to Dutch standards is sufficient to provide optimum ventilation for a room of approximately 15 $m^2$.

It has been found that the use of DC motors and controlled operation of these motors using control unit 18 make it possible to achieve a very low power consumption combined with optimum ventilation. It is even possible to operate motor 16 so as to pump air out of the room under stormy or other exceptional weather conditions. By varying the action of the various ventilators with respect to one another, it is always possible to provide optimum adaptation to the prevailing conditions. Control panel 19 may comprise a number of buttons, but it is also possible for it to be provided with a (light–) sensitive cell which is influenced by a remote control unit (not shown in more detail). It is possible to programme the device in such a manner that it is operated according to a number of fixed programmes, so that the user cannot completely disrupt the device.

By arranging the inlet and outlet openings essentially in the horizontal plane, on the one hand draught is as far as possible prevented and, on the other hand, the sound pressure is limited as far as possible. An inlet opening which lies in the vertical plane, as is customary in the prior art, will entail a higher noise level.

Apart from the filter which is shown here, further filters may be present. Consideration may be given, in particular, to a filter in feed opening 9.

It will be understood that FIGS. 1 and 2 merely show an exemplary embodiment of the invention and that numerous variants are possible. Thus it is possible, for example, to use a radial arrangement instead of the axial blade wheel 14 which is shown. The same applies to blade wheel 16.

Figure 3:
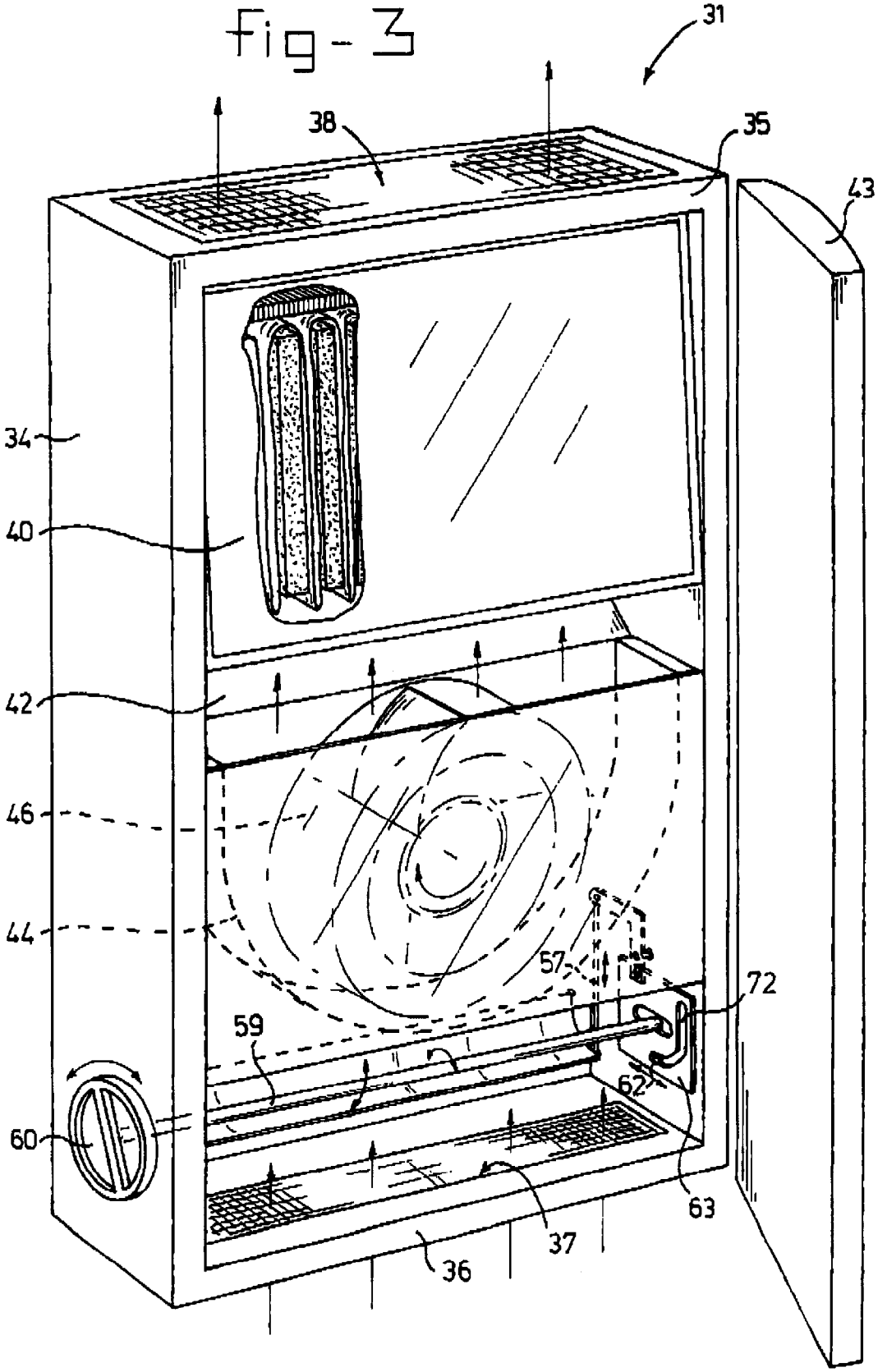
FIG. 3 shows a cut away perspective view of a further variant of the air-conditioning device according to the invention.
Figure 4:
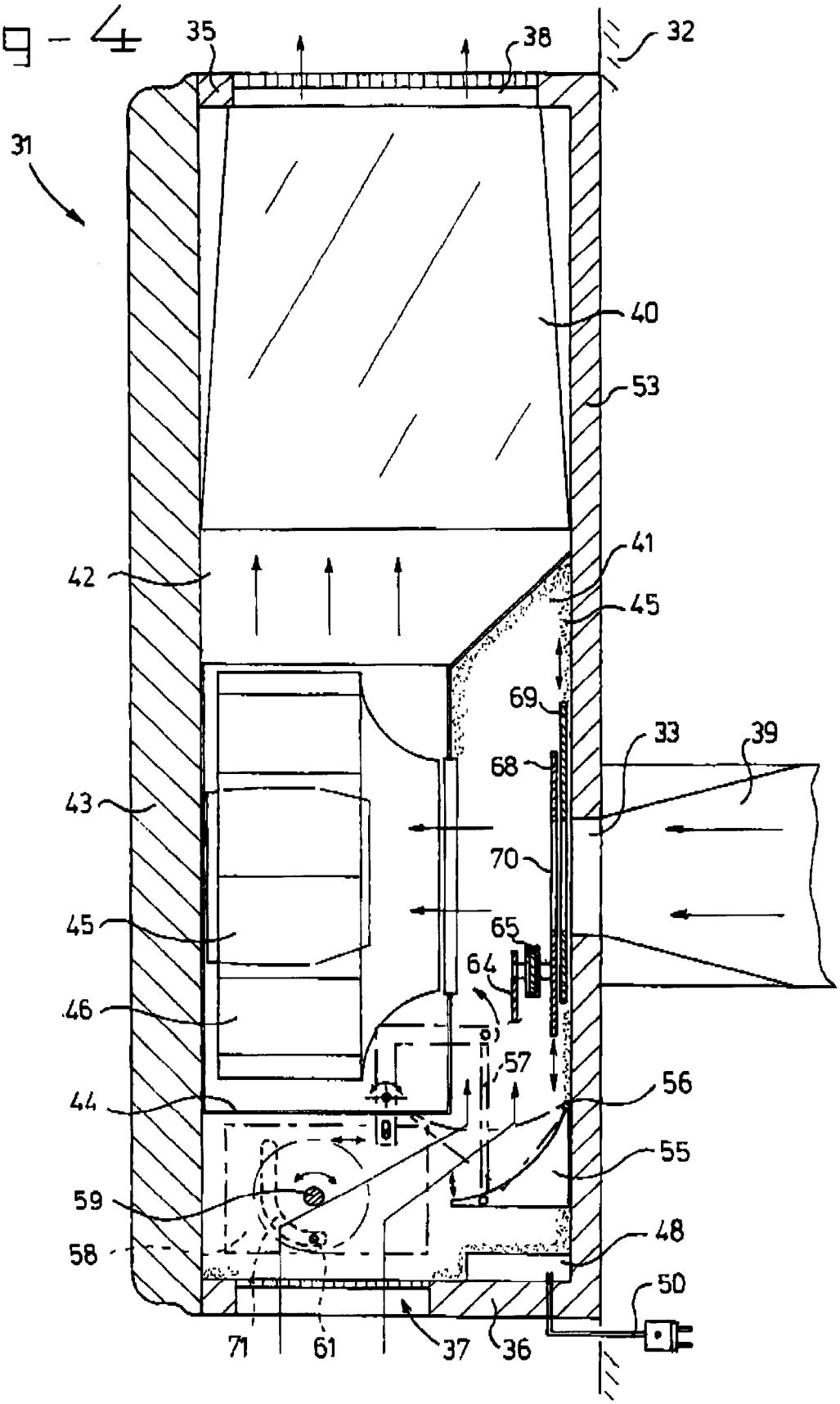
FIG. 4. shows a side view, in cross section, of the device in accordance with FIG. 3.
Figure 5:
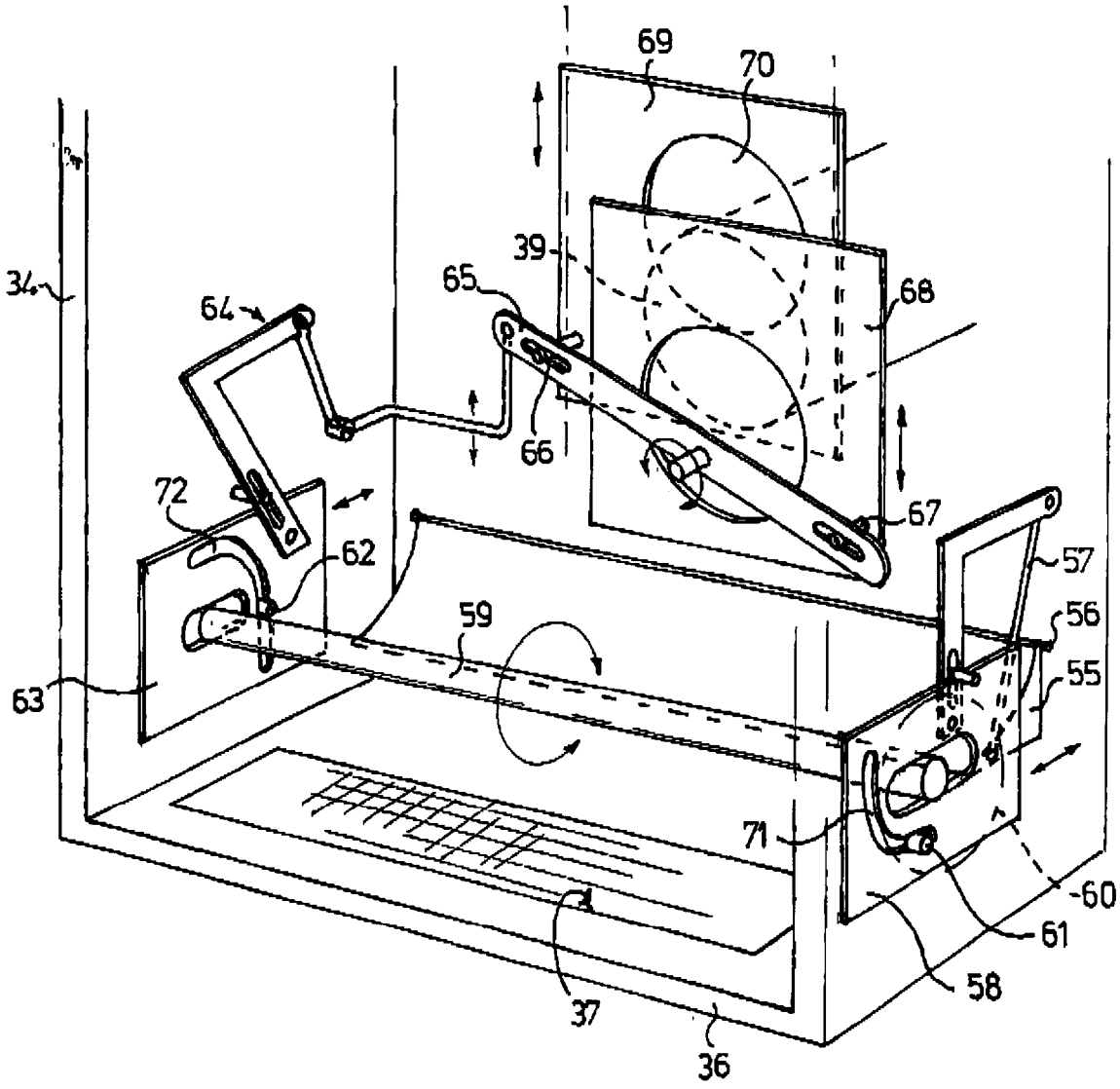
FIG. 5 shows a detail of the device in accordance with FIGS. 3 and 4 which provides further details of the control means.

FIGS. 3–5 show a variant of the air-conditioning device according to the invention. This device is denoted overall by 31 and is designed to be arranged against a wall 32. In this wall 32, which delimits a room or the like from the environment, there is a hole 33 for supplying fresh air via the feed opening 39, which is arranged in the rear wall 53 of the device 31.

The device moreover comprises two walls 34 which lie opposite one another and a top wall 35 and base 36. A removable cover 43 is arranged on the front side. An inlet opening 37 is arranged in the base 36, while the top wall 35 is provided with an outlet opening 38. A filter 40 is arranged between the inlet opening 37 and outlet opening 38. A buffer chamber 42 is delimited beneath this filter 40. This buffer chamber 42 opens out at the outlet of a ventilator housing 44. A ventilator motor 45, which may comprise the DC motor 15 described above, is arranged in this ventilator housing. A blade wheel 46 is backwardly curved is also provided. The rotational speed of the blade wheel 46 is set by means of a control unit 48. A power supply cable is denoted by 50.

Part of the ventilator housing 44 projects into first chamber 41. This chamber is provided with a sound-insulating lining 45. Moreover, an inlet opening 37 which is arranged in base 36 and a feed opening 39 for fresh air, as described above, open out into the first chamber 41. The inlet opening 37 for fresh air may be closed off with the aid of tilting flap 55. The feed opening 39 for fresh air is controlled with the aid of two slide plates 68, 69 each provided with an opening 70. These slide plates are able to move with respect to one another. The maximum diameter is established if the openings 70 lie one above the other, and as the openings move away from one another the size of the opening will become increasingly smaller but will continue to lie in the centre, so that the increase in noise is limited as far as possible.

In addition to a control button for control unit 48, the device in accordance with FIGS. 3–5 is provided with a control button 60. In the present case, this button is present on two sides and is connected by means of a rigid rod 59 which is connected to both buttons. Pins 61, 62 are present, in different angular positions, on each of the control buttons 60. Pin 61 engages in the cam track 71 of a slide plate 58. This slide plate 58 is provided with a central slot for accommodating rod 59. By rotating button 60, slide 58 is moved to and for by the engagement between slot 71 and pin 61. As a result, via connection 57, tilting flap 55, which is arranged pivotably, is actuated at pivot 56.

Slide 63 is moved to and for in a corresponding manner by the action of pin 62 in cam track 72. Connection 64 is coupled to rocker arm 65, which by means of a pin is pivotably connected to a fixed part of the housing. This rocker arm moves pins 66 and 67 in opposite directions. Pin 66 is connected to slide 69, while pin 67 is connected to slide 68.

The shape of the cam track 71, 72 and the position of the pins 61, 62 is selected to be such that the control ensures that the total area of flow of the inlet opening 37 and the feed opening 39 for fresh air remains essentially constant. As a result, it is possible, depending on the conditions, to supply exclusively fresh air or, for example in the event of disasters, to shut off the system entirely from the outside world. In both cases, and also in all other intermediate cases, the flow resistance to which the ventilator is subject is equal and the noise performance can be optimized.

Using a backwardly curved blade wheel makes it possible to design the outlet of the ventilator housing 44 so as to extend across the entire width of the housing, so that the air speed is limited and the noise pollution is reduced in this way. In the embodiment in accordance with FIGS. 3–5, it is also preferred to use an HEPA filter, and more particularly in accordance with standard EU 9/10.

The above text merely describes two embodiments of the present invention. It will be understood by the person skilled in the art that numerous further variant are possible without departing from the scope of the present application.

What is claimed is:

1. An air-conditioning device, comprising:

a holder positionable against a wall of a room and provided with an room inlet opening in a base of the holder, a room outlet opening, and a fresh-air opening connected to an air supply external to the room;

a mechanical air-displacement means for displacing air out of the fresh-air opening, the mechanical air-displacement means having only a single ventilator;

a filter located downstream of the mechanical air-displacement means and receiving the displaced air;

a first chamber delimited by the base of the holder, a wall of the holder adjacent the fresh-air opening, the mechanical air-displacement means positioned in the first chamber downstream of the room inlet opening and the fresh-air opening; and a control means for influencing a relative volume of air which is displaced through the fresh-air opening and the room inlet opening.

2. The air conditioning device of claim 1, wherein, the control means for influencing a relative volume of air which is displaced through the fresh-air opening and the room inlet opening comprises a tilting flap controlling air introduced from the room inlet opening and operatively connected to two slide plates, the two slide plates being movable with respect to each other; and a slide controlling air introduced from the fresh-air opening, the slide operatively interconnected to one of the two slide plates and controlling air introduced from the fresh-air opening based on a position of the one slide plate.

3. Device according to claim 1, wherein an inlet of said mechanical air displacement means is perpendicular to said wall.

4. Device according to claim 3, in which said control means comprise a flap assembly which influences a ratio between an inlet cross section of the fresh-air opening and that of the room inlet opening.

5. Device according to claim 1, in which said control means comprise a flap assembly which influences the ratio between an inlet cross section of the fresh-air opening and that of the room inlet opening.

6. Device according to claim 1, in which an inlet of said mechanical air-displacement means is directly connected to the fresh-air opening, an its outlet opens out into said first chamber, further mechanical air-displacement means arranged downstream of the said filter, the said control means comprising a control unit which influences the displacement of air effected by each of said air-displacement means and the relative volume of air which is displaced by each of the said displacement means.

7. Device according to claim 1, in which said ventilator is driven by a separate DC motor.

8. Device according to claim 1, in which the holder comprises a top surface in which the outlet opening is arranged.

9. Device according to claim 1, in which a front wall of the holder is arranged so as to be at least partially removable, in order to provide access to the filter.

10. Device according to claim 1, in which the filter comprises a folded HEPA filter.

* * * * *